US008591249B2

(12) United States Patent
Harnish et al.

(10) Patent No.: US 8,591,249 B2
(45) Date of Patent: Nov. 26, 2013

(54) FLEXIBLE BREAKAWAY CONNECTOR

(75) Inventors: Scott David Harnish, Lancaster, PA (US); Timothy Wickard, Carlisle, PA (US)

(73) Assignee: Souraiu USA, Inc., York, PA (US)

( * ) Notice: Subject to any disclaimer, the term of this patent is extended or adjusted under 35 U.S.C. 154(b) by 79 days.

(21) Appl. No.: 13/210,888

(22) Filed: Aug. 16, 2011

(65) Prior Publication Data

US 2012/0045924 A1 Feb. 23, 2012

Related U.S. Application Data

(60) Provisional application No. 61/374,483, filed on Aug. 17, 2010.

(51) Int. Cl.
*H01R 13/58* (2006.01)

(52) U.S. Cl.
USPC ..... 439/474; 439/349; 439/447

(58) Field of Classification Search
USPC ..... 439/445, 447, 448, 638, 474, 349
See application file for complete search history.

(56) References Cited

U.S. PATENT DOCUMENTS

| | | | | | |
|---|---|---|---|---|---|
| 706,927 | A * | 8/1902 | Goodrich | 439/451 |
| 2,510,125 | A * | 6/1950 | Meakin | 174/47 |
| 3,347,566 | A * | 10/1967 | Nelson | 285/1 |
| 3,760,134 | A * | 9/1973 | McCray | 200/52 R |
| 4,077,690 | A * | 3/1978 | Koether | 439/320 |
| 4,109,989 | A * | 8/1978 | Snyder et al. | 439/140 |
| 4,166,664 | A * | 9/1979 | Herrmann, Jr. | 439/258 |
| 4,415,219 | A * | 11/1983 | Kuhl et al. | 439/694 |
| 4,550,967 | A * | 11/1985 | Riches et al. | 439/332 |
| 4,583,084 | A * | 4/1986 | Henderson et al. | 340/573.4 |
| 4,664,459 | A * | 5/1987 | Flanagan et al. | 439/502 |
| 4,676,572 | A * | 6/1987 | Booker | 439/301 |
| 4,698,717 | A * | 10/1987 | Scheid | 361/1 |
| 5,024,604 | A * | 6/1991 | Savin et al. | 439/345 |
| 5,058,172 | A * | 10/1991 | Ross et al. | 381/122 |
| 5,090,916 | A * | 2/1992 | Magnier | 439/352 |
| 5,116,088 | A * | 5/1992 | Bird | 285/319 |
| 5,118,309 | A * | 6/1992 | Ford | 439/620.21 |
| 5,427,542 | A | 6/1995 | Gerow | |
| 5,486,117 | A * | 1/1996 | Chang | 439/357 |
| 5,599,129 | A | 2/1997 | Clifton et al. | |
| 5,752,847 | A * | 5/1998 | McCormick | 439/349 |
| 6,139,354 | A * | 10/2000 | Broussard | 439/447 |
| 6,461,192 | B1 * | 10/2002 | Kwoka | 439/505 |
| 6,776,638 | B2 | 8/2004 | Thurston | |
| 6,848,930 | B2 * | 2/2005 | Fukuda | 439/349 |
| 6,910,911 | B2 * | 6/2005 | Mellott et al. | 439/358 |
| 7,100,879 | B2 * | 9/2006 | Podue et al. | 248/220.31 |
| 7,150,642 | B1 * | 12/2006 | Bakke et al. | 439/271 |
| 7,195,512 | B2 * | 3/2007 | Jenkinson et al. | 439/372 |

(Continued)

OTHER PUBLICATIONS

JBX Series Catalog, Sealed and Unsealed Push-Pull Connectors, Souriau Connection Technology, Sep. 2006, pp. 1-44.

*Primary Examiner* — Neil Abrams
*Assistant Examiner* — Travis Chambers
(74) *Attorney, Agent, or Firm* — McNees Wallace & Nurick LLC

(57) ABSTRACT

A connector which has a flexible portion which allows the connector to bend in response to non-axial forces applied thereto. When off-axis forces are applied to the connector or a mating connector, the off-axis forces do not cause oblique loading on the connector or mating connector.

18 Claims, 11 Drawing Sheets

(56) References Cited

U.S. PATENT DOCUMENTS

| | | | | |
|---|---|---|---|---|
| 7,252,533 | B1 * | 8/2007 | Lee | 439/382 |
| 7,470,137 | B2 * | 12/2008 | Burke et al. | 439/344 |
| 7,500,882 | B2 * | 3/2009 | Goetz et al. | 439/669 |
| 2007/0049098 | A1 * | 3/2007 | Feinbloom et al. | 439/349 |
| 2009/0130887 | A1 | 5/2009 | Guilbert et al. | |
| 2010/0197148 | A1 | 8/2010 | Rudisill et al. | |

* cited by examiner

FLEXIBLE BREAKAWAY CONNECTOR

FIELD OF THE INVENTION

The present invention relates to an automatically locking connector system for joining a first connector body with a second connector body. More particularly, the present invention relates to an automatically locking connector system that automatically disengages at a predetermined force.

BACKGROUND OF THE INVENTION

Automatically locking connector systems are used for a variety of applications, such as electrical, fluidic, mechanical, optical, hydraulic or pneumatic systems, to provide a connection between various components and devices. A typical connector may comprise a female connector assembly and a male connector assembly that are designed to be engaged and disengaged with one another. Prior patents describe a coupling mechanism, having one coupler half that is inserted into the other half and a sleeve on one half, which rotates against a torsional spring force as a result of the camming action of complementary tabs on the sleeve and the inserted coupler half. The restoring force of the spring causes the sleeve to rotate into a locking position after the complementary tabs have passed each other. The tabs prevent disengagement of the coupler halves until the sleeve is twisted to permit the tabs to clear each other during uncoupling.

With telescopically mating electrical connectors, such as a plug and a socket, it is often desirable or necessary to lock the two connector bodies together after their conductive contacts have been physically and electrically joined. Single conductor connectors with some form of bayonet joint may be rotated to a locking position. Multiple male and female contacts, however, must be slidingly joined telescopically without rotation, and typically have used a pliable plastic connector body which is deformed as a catch on one connector body rides over a detent on the other connector body to a locking position beyond the detent.

Many locking connectors are designed to lock in the mated position and must be manually disengaged. However, in certain applications, it is desirable that the connectors automatically disconnect when a force exceeding a predetermined level is applied to the connector assembly or a cable extending from the connector assembly. For example, requirements exist in some industries and in various applications that a mated pair of connectors disengage (or break away) before the cable or the connectors are damaged or before the equipment or machinery to which the cable is attached is damaged. This helps to prevent damage to expensive machinery, components or personnel someone inadvertently trips over a cord, as the connector will disengage rather than transfer the force to the equipment. In other applications or environments, it is important to have a connector which can be easily engaged and disengaged quickly, without the need for cumbersome steps such as rotating the connector. This is particularly true in harsh environments or in military applications in which a soldier must be able to quickly connect and disconnect from equipment and the like.

While breakaway connectors, such as the Souriau JDX connectors, are known in the industry, these types of connectors can malfunction or be damaged if a significant off-axis or non-axial force is applied to the axis of the connector. As one half of the connector is mounted to a fixed member, the application of a significant off-axis or non-axial force can cause the connector halves to twist, which in turn causes the contacts to be damaged. In addition, if the off-axis or non-axial force does not translate to a large enough lateral force, the connector may not break away but remain connected. These are unacceptable results. It would, therefore, be beneficial to have a breakaway connector in which the fixed connector was flexible and able to bend when a off-axis force is applied, thereby allowing the off-axis force to more easily be translated to an axial force to prevent damage to the connector and allow the connector to be properly disengaged when an appropriate off-axis or axial force is applied.

SUMMARY OF THE INVENTION

An exemplary embodiment is directed to a connector which has a flexible portion which allows the connector to bend in response to non-axial forces applied thereto. When off-axis forces are applied to the connector or a mating connector, the off-axis forces do not cause oblique loading on the connector or mating connector.

An exemplary embodiment is directed to a breakaway connector for mating with a mating connector. The breakaway connector has a first end and a second end, with the second end configured to mate with the mating connector. A flexible portion is positioned between the first end and the second end. The flexible portion allows the second end to move relative to the first end. The second end is moveable to allow the mating connector to be properly disengaged from the second end even if off-axis forces are applied to the mating connector.

An exemplary embodiment is directed to a connector for mating with a mating connector. The connector has a flexible portion provided between a first end and a second end of the connector. The flexible portion allows the second end to move relative to the first end. The mating connector can be mated or unmated to the second end at an angle relative to the longitudinal axis of the unflexed connector without damaging the connector or the mating connector.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

The present invention provides a connector system that automatically disengages at a predetermined breakaway force, whether such force is applied in line with the axis of the connector (axially) or not in line with the axis (off-axis), to prevent damage to the connector system, to equipment attached to the connector system and/or personal injury. The present invention also provides a connector system that is easy to connect and disconnect in harsh or challenging environments, thereby preventing damage to the connector system and equipment attached thereto and allowing the user to quickly enter or leave any area without concern for damaging the equipment, thereby providing maximum flexibility and safety to the user/operator. The invention will be described below relative to illustrative embodiments. Those skilled in the art will appreciate that the present invention may be implemented in a number of different applications and embodiments and is not specifically limited in its application to the particular embodiments depicted herein.

An example of a breakaway connector according to the present invention is a male-female connector. A male-female connector is expressly meant to refer to any connector that relies on axial insertion of a male part into a female part to establish a connector, including, without limitation, male-female pin connectors, male-female plugs and receptacles, and male-female flat connectors and receptacles. The characteristic feature of a male-female connector of this type is that the respective male and female parts of the connector are engageable by pressing the respective parts together axially and are disengageable by pulling on the respective parts, relative to each other. This feature will be discussed further herein below.

In general, the flexible connector and the connector assembly are positioned at respective ends of cables or other components which contain any known electrical or fiber optic conductors, including, for example and without limitation, one or more conductors for carrying power, unidirectional signal traffic, and/or bidirectional signal traffic.

Figure 10:
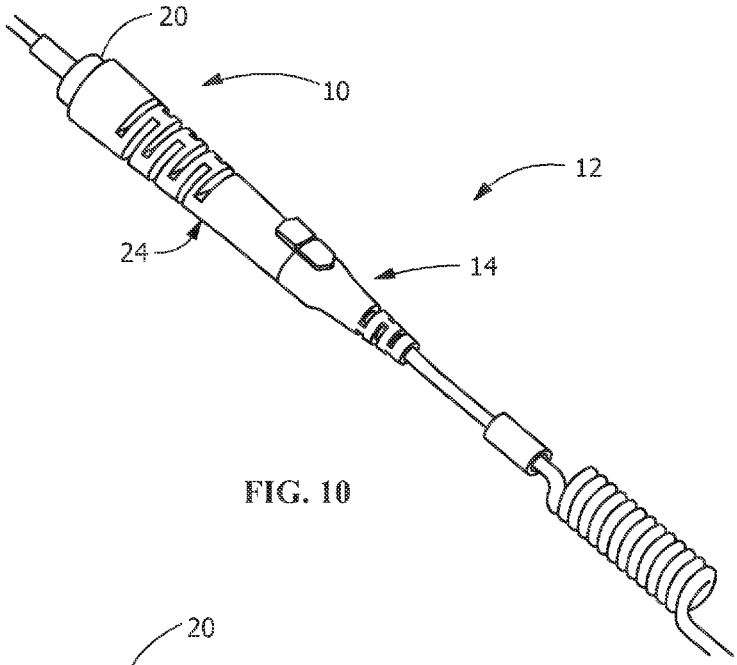
FIG. 10 is a perspective view of a second alternate exemplary embodiment of a flexible breakaway connector mated to a mating connector.

FIGS. 1-13 illustrate a flexible breakaway connector 10 according to various exemplary embodiments of the invention. According to the illustrative embodiment, the connector 10 is part of a breakaway connector assembly 12 (FIG. 10) which can be used in an electrical application, though one skilled in the art will recognize that the connector and connector assembly can be implemented in any suitable system. The connector assembly 12 comprises the flexible connector 10 and a mating connector 14 configured to engage the flexible connector 10.

Figure 1:
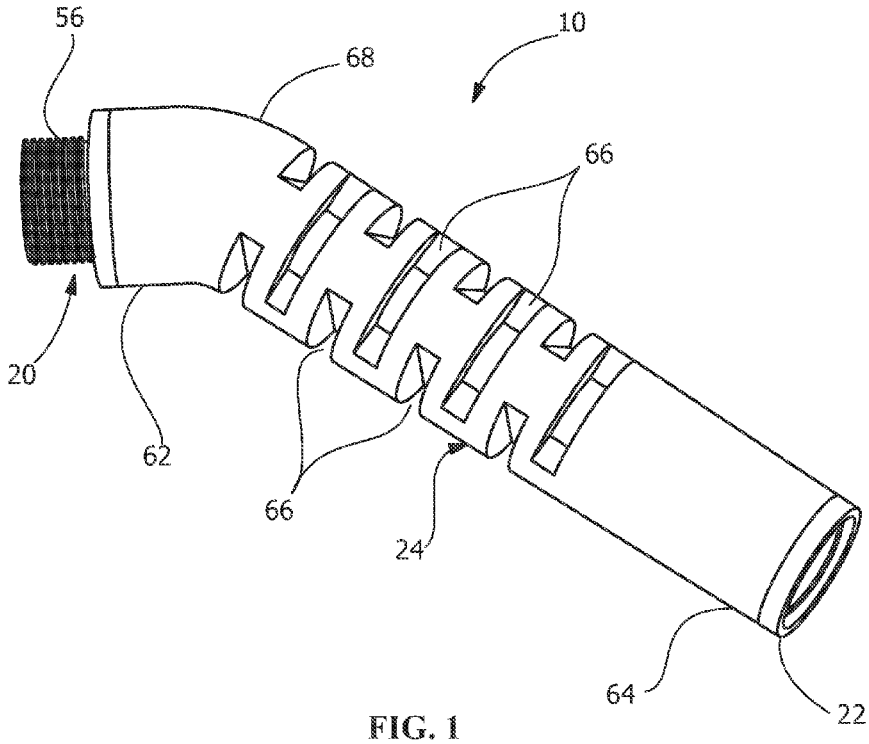
FIG. 1 is a perspective view of an exemplary embodiment of a flexible breakaway connector for use with a breakaway connector system.
Figure 2:
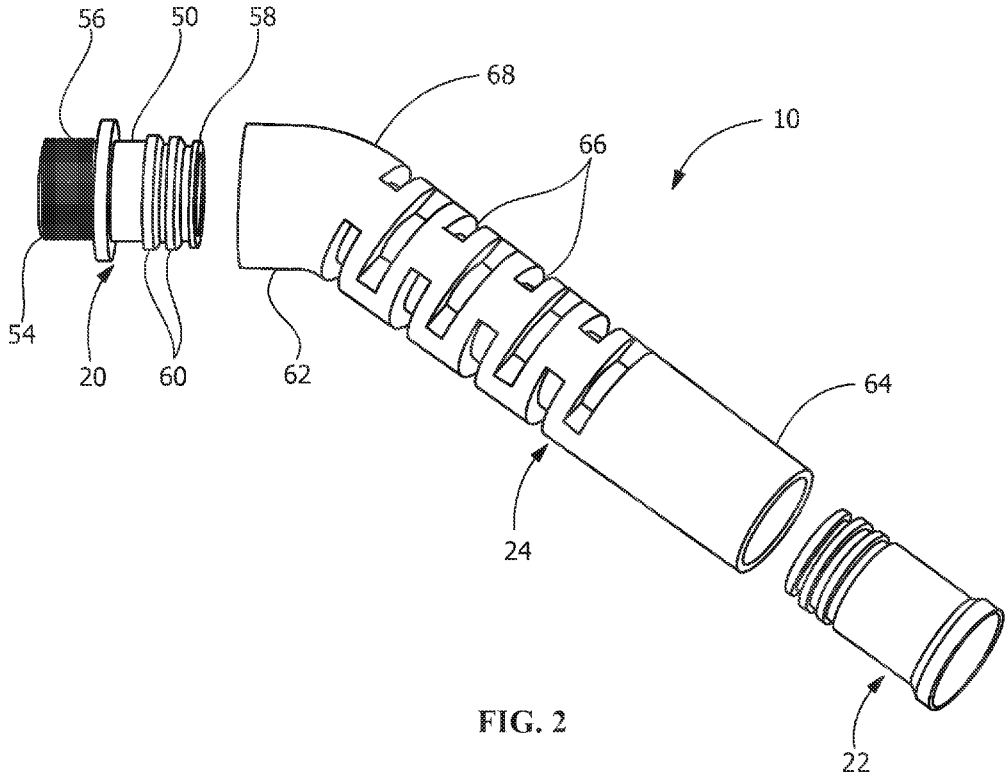
FIG. 2 is an exploded perspective view of the embodiment of the flexible breakaway connector shown in FIG. 1.
Figure 3:
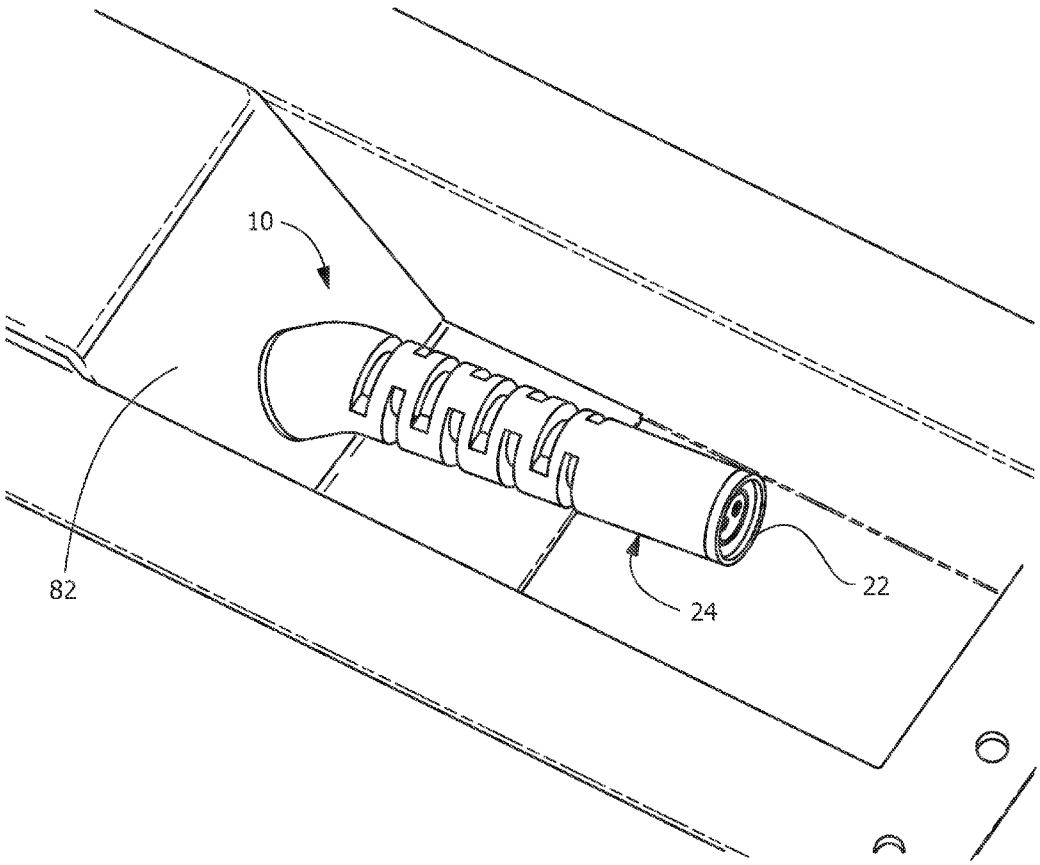
FIG. 3 is a perspective view of the flexible breakaway connector of FIG. 1 mounted to a panel.

As best shown in FIGS. 1 and 2, the flexible connector 10 has a feed-through member 20, an in-line receptacle connector 22 and a flexible portion or overmolded flexible relief section 24. As best shown in FIGS. 14-19, the in-line receptacle connector 22 is a female connector having a cylindrical shaped housing with female contacts 26 enclosed in terminal-receiving cavities 28 of an insulative housing 30. The female contacts are terminated to respective conductors 32 (FIGS. 11-12) of cable 34 proximate the first end 36 of the housing 30. As is best shown in FIGS. 14 through 19, the housing 30 is mounted in a cover 38 such that a recess 40 is provided between the cover 38 and a second end 42 of the housing 30. Radially extending projections 43 extend from an outer surface of an insert provided in the housing 30 into the recess 40. The projections 43 have sloped or arcuate surfaces. A retaining ring 44 is mounted in a groove 46 provided in a wall of the recess 40 and cooperates with the mating connector 14, as will be described. The outside surface of the cover 38 has at least one projection or recess 48 provided thereon to cooperate with the overmolded relief section 24. FIGS. 14-15, 16-17 and 18-19 show different exemplary embodiments which are meant to be illustrative and not limiting.

Figure 11:
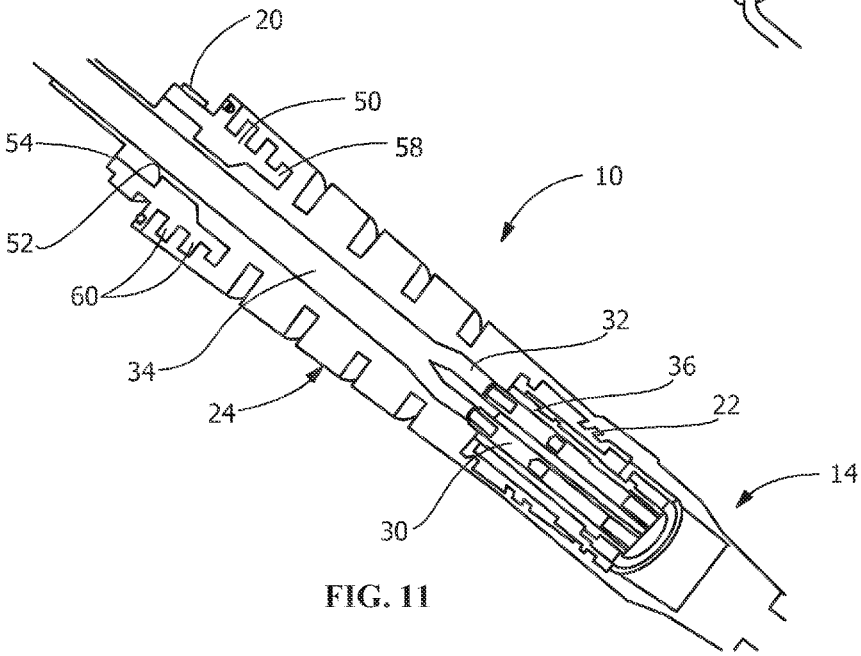
FIG. 11 is a perspective cross-sectional view of the flexible breakaway connector of FIG. 10 mated to a mating connector.

As best shown in FIG. 11, the feed-through member 20 has a housing 50 with an opening 52 to allow the cable 34 to extend therethrough. A first end 54 of the housing has threads 56 for mounting to a panel or the like. A second end 58 has at least one projection or recess 60 provided thereon to cooperate with the overmolded relief section 24.

Figure 12:
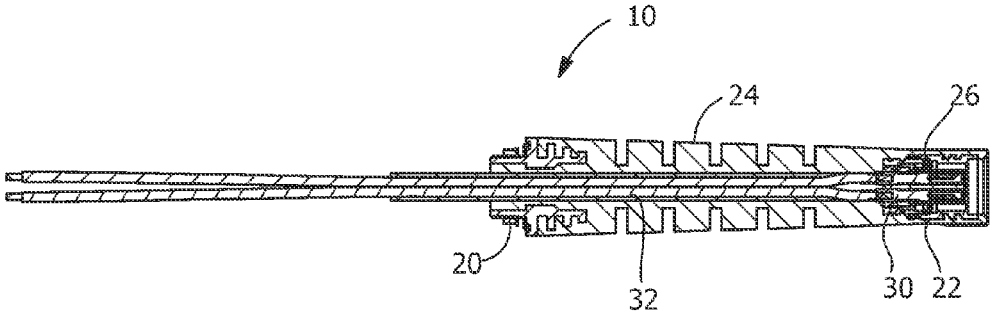
FIG. 12 is a cross-sectional view of the flexible breakaway connector of FIG. 10.
Figure 13:
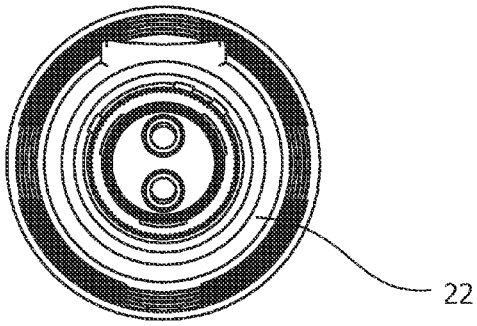
FIG. 13 is a front plan view of the flexible breakaway connector of FIG. 10.
Figure 14:
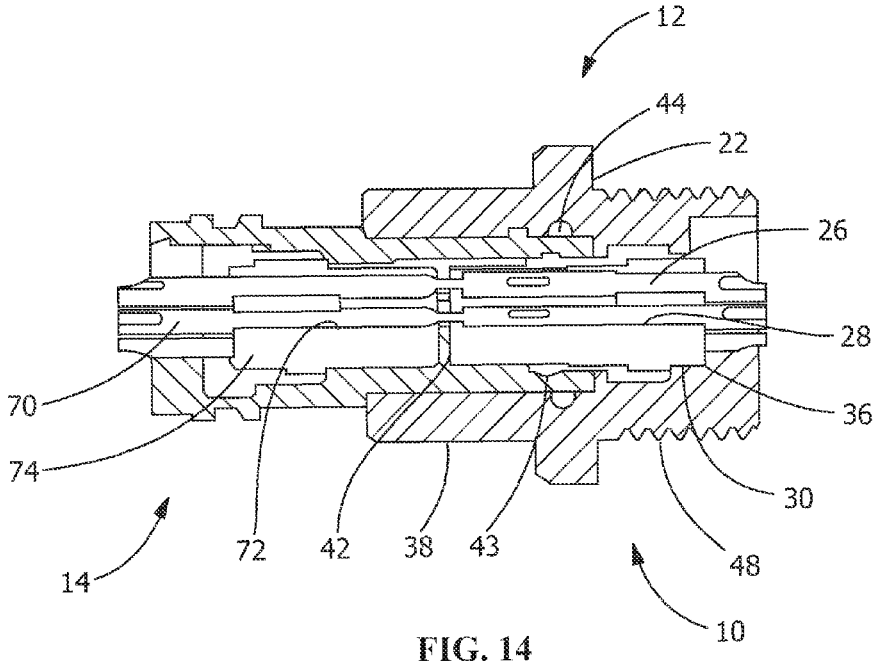
FIG. 14 is a cross-sectional view of an exemplary receptacle connector of the flexible connector mated to an exemplary embodiment of a mating connector.
Figure 15:
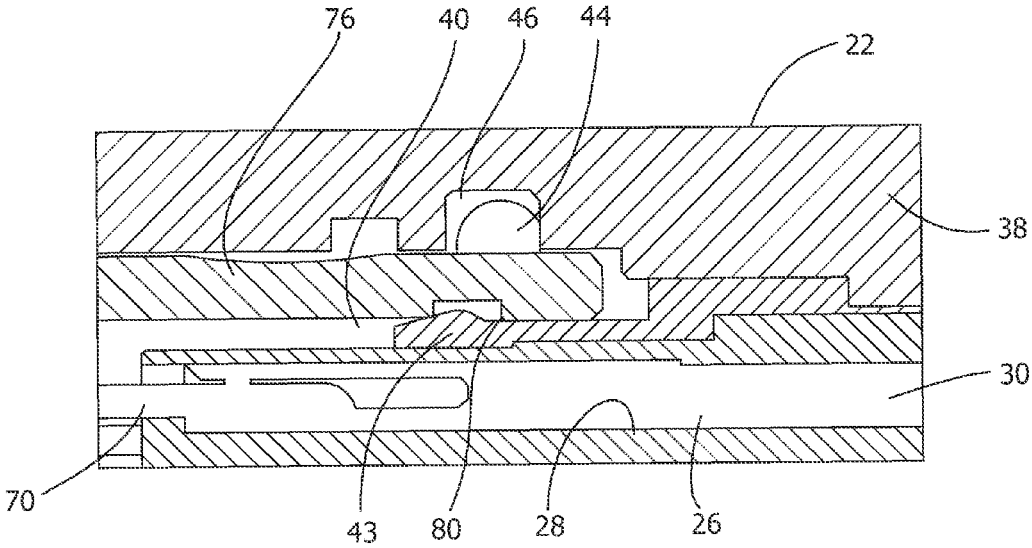
FIG. 15 is an enlarged cross-sectional view of the breakaway mating area between the receptacle connector and the mating connector of FIG. 14.
Figure 16:
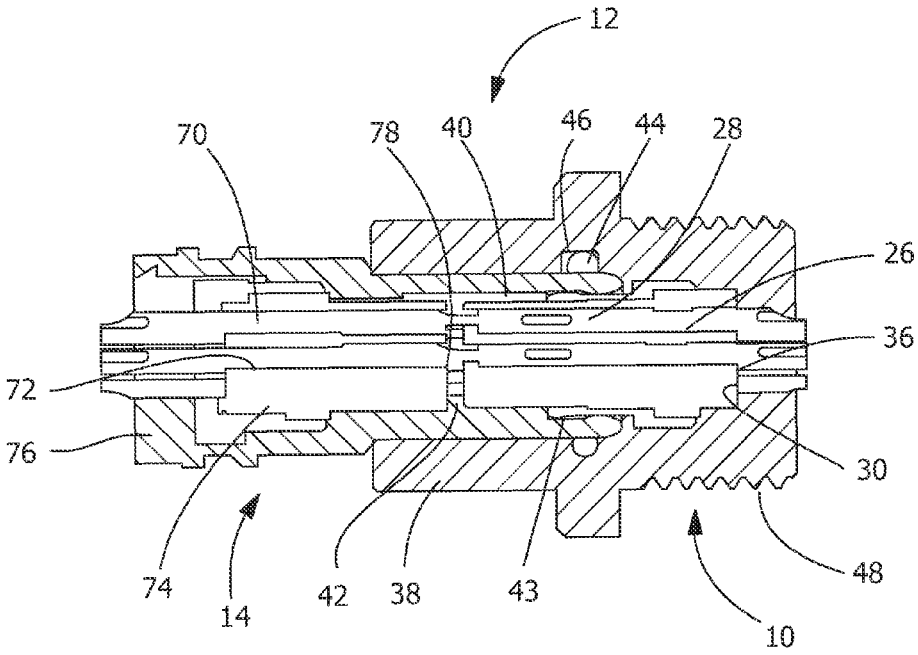
FIG. 16 is a cross-sectional view of the receptacle connector of the flexible connector mated to a second exemplary embodiment of a mating connector.
Figure 17:
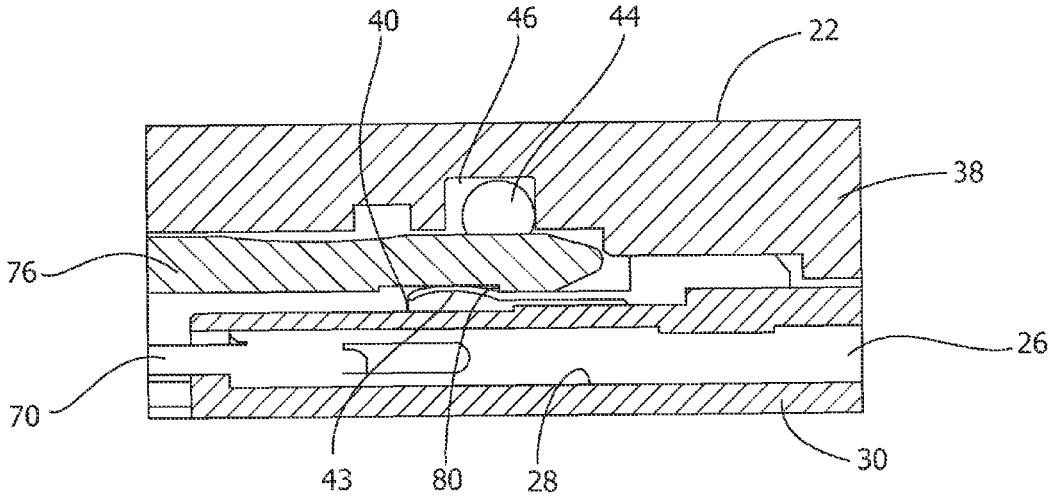
FIG. 17 is an enlarged cross-sectional view of the breakaway mating area between the receptacle connector and the mating connector of FIG. 16.
Figure 18:
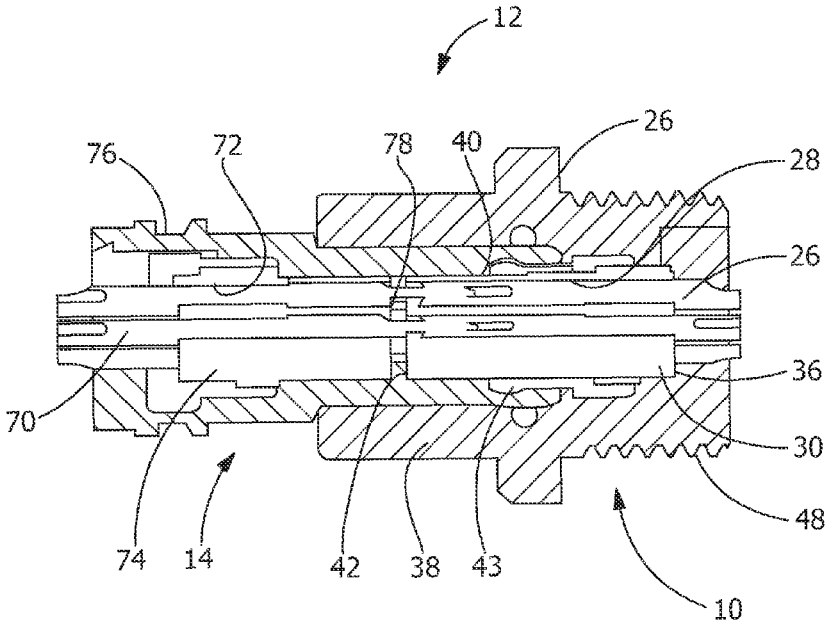
FIG. 18 is a cross-sectional view of the receptacle connector of the flexible connector mated to a third exemplary embodiment of a mating connector.
Figure 19:
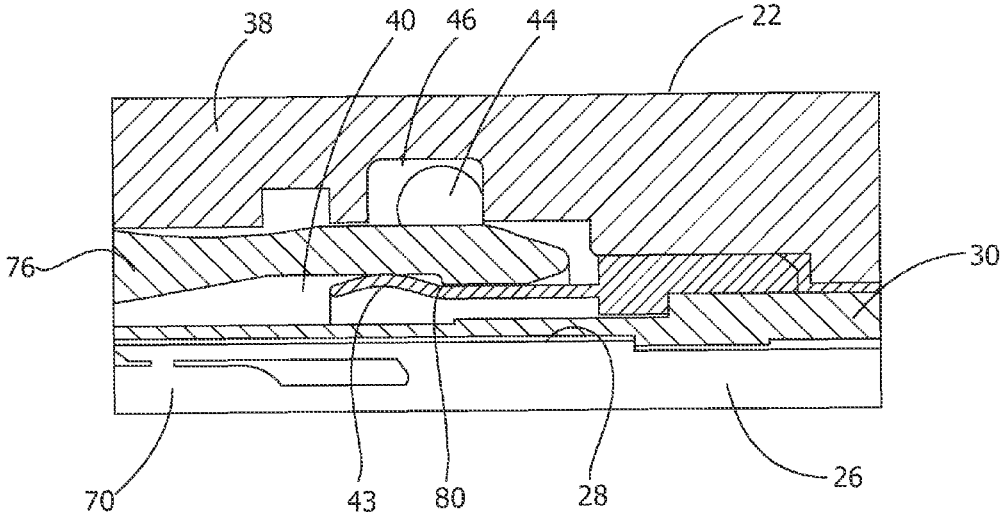
FIG. 19 is an enlarged cross-sectional view of the breakaway mating area between the receptacle connector and the mating connector of FIG. 18.

As shown in FIGS. 1 and 2, overmolded section 24 has a first end 62 which houses the feed-through member 20 and a second end 64 which houses the receptacle connector 22. During the manufacturing process, the material of the overmolded section 24 flows into engagement with the projections and recesses 48, 60 (FIG. 11) of the receptacle connector 22 and the feed-through member 20, such that as the material sets, a secure connection is provided between the overmolded section 24 and both the receptacle connector 22 and the feed-through member 20. As best shown in FIG. 12, the material also flows inside of the feed-through connector 20 to cooperate with the cable 34. This provides sealing, strain relief and proper positioning for the cable 34. Referring again to FIGS. 1 and 2, overmolded section 24 has at least one recess 66 provided therein. The recess or recesses 66 allow the overmolded section 24 to maintain its strength in the axial direction while allowing the overmolded section to bend and twist in a non-axial direction. In the embodiment shown if FIGS. 1 through 3, the overmolded section 24 has a bend 68 which is molded therein. However, other embodiments may have no bend or different angle bend. Such exemplary embodiments are represented in FIGS. 4-9 and 10-13.

Referring to FIGS. 14-19, the exemplary mating connector 14 is a male connector having a cylindrical-shaped housing with male contacts 70 enclosed in terminal-receiving cavities 72 of an insulative housing 74. The male contacts 70 are configured to mate with the female contacts 26 of the receptacle connector 22 of the flexible connector 10. The male contacts are terminated to respective conductors of a cable in any known manner. The housing 74 is mounted in a cover 76 such that the cover 76 extends beyond the end 78 of the housing 74. Radially extending shoulders 80 extend from an inner surface of the cover 76 proximate the free end thereof. The free end of the cover 76 and the shoulders 80 cooperate with the retaining ring 44 and the projection s to maintain the mating connector 14 in position relative to the flexible connector 10.

The retaining ring 44 is preferably in the form of a ring that can expand in diameter, which extends by more than 180 degrees about the axis of the receptacle connector 22. The dimensions and configuration of the retaining ring 44 allow the retaining ring to expand within the recess 40. As the retaining ring 44, projections 43, and shoulders 80 are of the type well known in the industry, a more detailed explanation can be found in U.S. Pat. No. 5,427,542 which is hereby incorporated by reference in its entirety.

If a sufficient rearward force is applied to the mating connector 14 or the cable attached thereto, the shoulders 80 press the retaining ring 44. This causes the retaining ring 44 to "ride" up the ramp formed by movement of the shoulders 80 over the projections 43. The retaining ring expands in diameter to allow for the removal of the mating connector 14 from the flexible connector 10 when sufficient force is applied. After the mating connector 14 has been pulled completely out of the flexible connector 10, the retaining ring 44 remains in the recess 40. The same mating connector 14 or similar mating connector can be reinstalled in the field, by merely pressing the mating connector 14 in the forward direction until the shoulders 80 move past the projections 43, causing the free end of the cover 76 to engage and expand the retaining ring 44, thereby retaining the mating connector 14 in the flexible connector until such time as a sufficient force is again applied.

The force required to expand the retaining ring 44 depends upon the construction of the retaining ring 44, and on the angles of the projections 43 and shoulders 80. The more gradual the angles and the more resilient the retaining ring 44, the less axial force required to pull out the mating connector 14 from the flexible connector 10.

While the illustrative breakaway connector assembly 12 is shown using a retaining ring, projections and shoulders, many other types of breakaway retaining systems are known and can be used without departing from the scope of the invention. It is emphasized that the in-line receptacle connector 22 and the mating connector 14 shown and described herein are strictly examples in accordance with the present invention, and that other known connectors may be used instead of those shown.

In general, breakaway connector assemblies known in the prior art disengage appropriately when an axial removal force is applied to the connector or the cable. This allows the connectors and terminals to be disengaged in the axial direction. In so doing, the connectors and terminals are not damaged, as the disengagement occurs in a precise and controlled manner. However, in the field, it is uncommon for a disengagement force to be applied directly in line with the axis. It is typical for forces to be applied with an axial component and a transverse component. This can cause the connectors to fail, particularly in applications in which one of the connectors is fixed to a panel. In the prior art, if the transverse component is large, the mating connector is pulled from the fixed connector at an angle, which can cause damage to the retention members, the contacts and the connector in general. This results in the need to repair or replace the connectors or the components.

In addition, with the fixed connector of the prior art, when the mating connector or cable is pulled at an angle relative to the axial direction of engagement between the fixed connector and the mating connector, off-axis force causes oblique loading on the fixed connector, which increases the force needed to disconnect the mating connector from the fixed connector. If the angle of the applied force is more than a few degrees, it may be effectively impossible to disconnect the mating connector because of the oblique loading. The mating connector therefore binds, and the axial force required to separate the mating connector from the fixed connector can become higher than the designed axial force needed to disconnect the connectors, which may result in damage to the connector components or panel. As the fixed connector cannot properly accommodate these off-axis forces, the breakaway connector becomes essentially inoperable under these conditions.

The flexible connector 10 disclosed herein minimizes the possibility of failure, prevents the binding of the connectors, and allows for the proper disengagement and engagement of the mating connector 14 to the flexible connector 10 even if the force applied to the mating connector 14 or the cable attached thereto has large transverse components relative to the longitudinal axis of the flexible connector 10 is an unflexed position.

Figure 4:
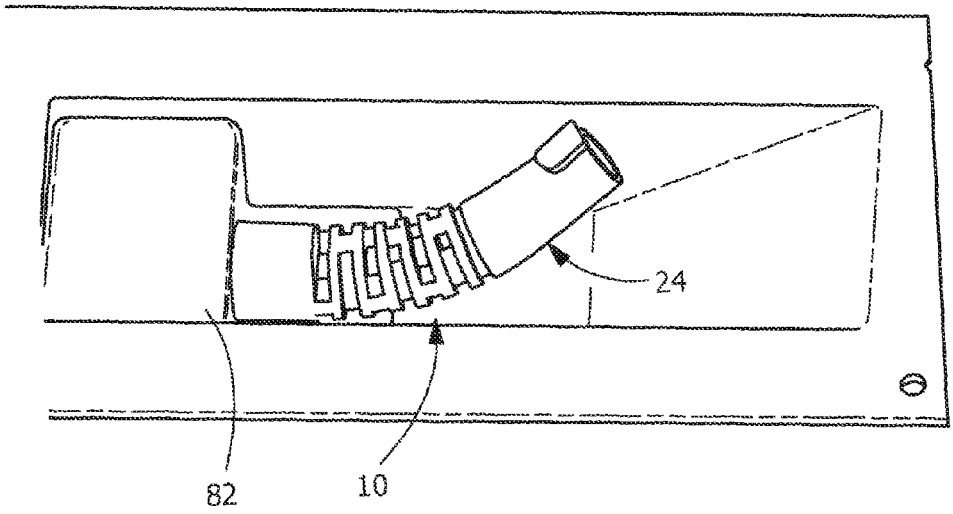
FIG. 4 is a top perspective view of a first alternate exemplary embodiment of a flexible breakaway connector mounted to a flush mounted panel.
Figure 5:
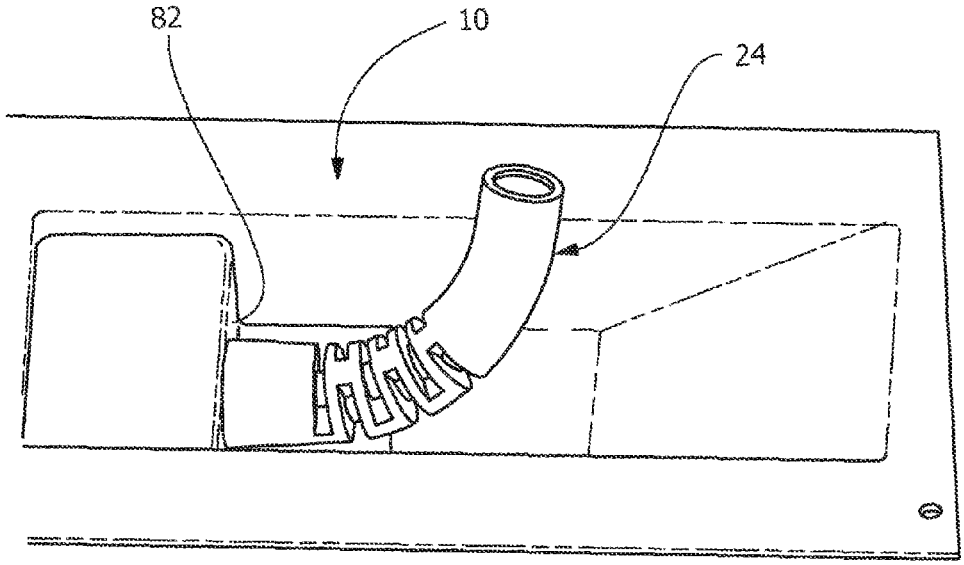
FIG. 5 is a front perspective view of the flexible breakaway connector of FIG. 4 mounted to a flush mounted panel.
Figure 6:
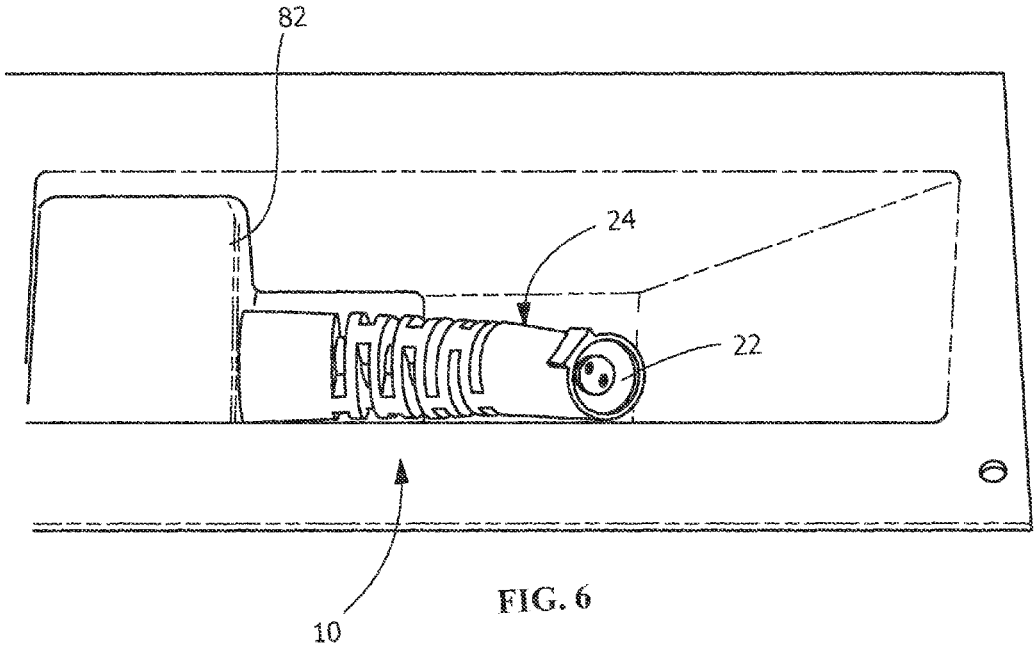
FIG. 6 is a perspective view of the flexible breakaway connector of FIG. 4 showing the movement and flexibility of a portion of the flexible breakaway connector.
Figure 7:
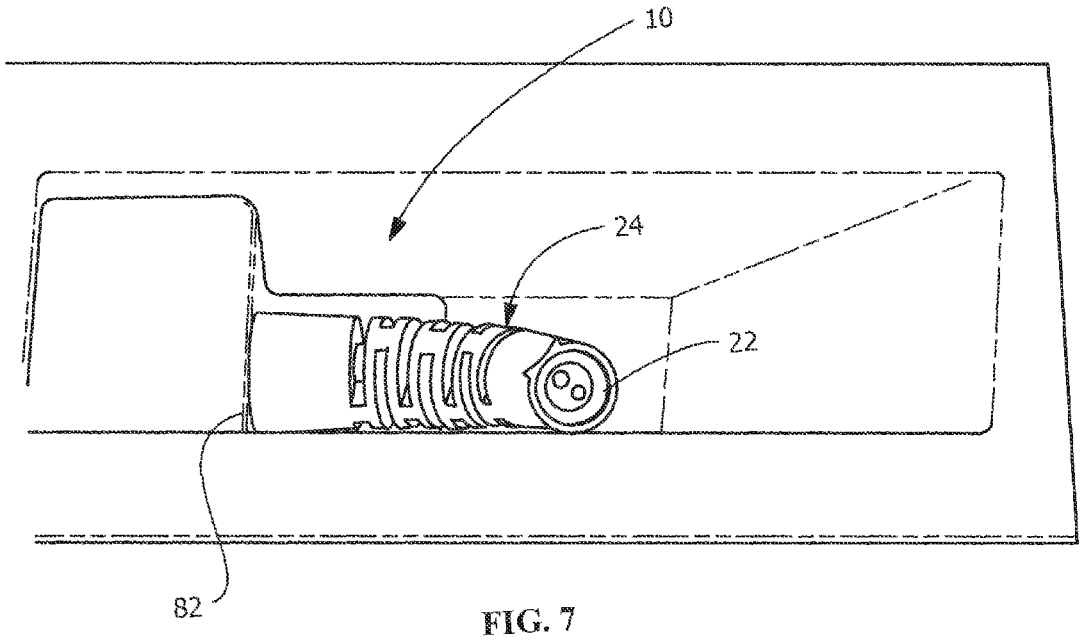
FIG. 7 is a perspective view of the flexible breakaway connector of FIG. 6 showing the additional movement and flexibility of the portion of the flexible breakaway connector.
Figure 8:
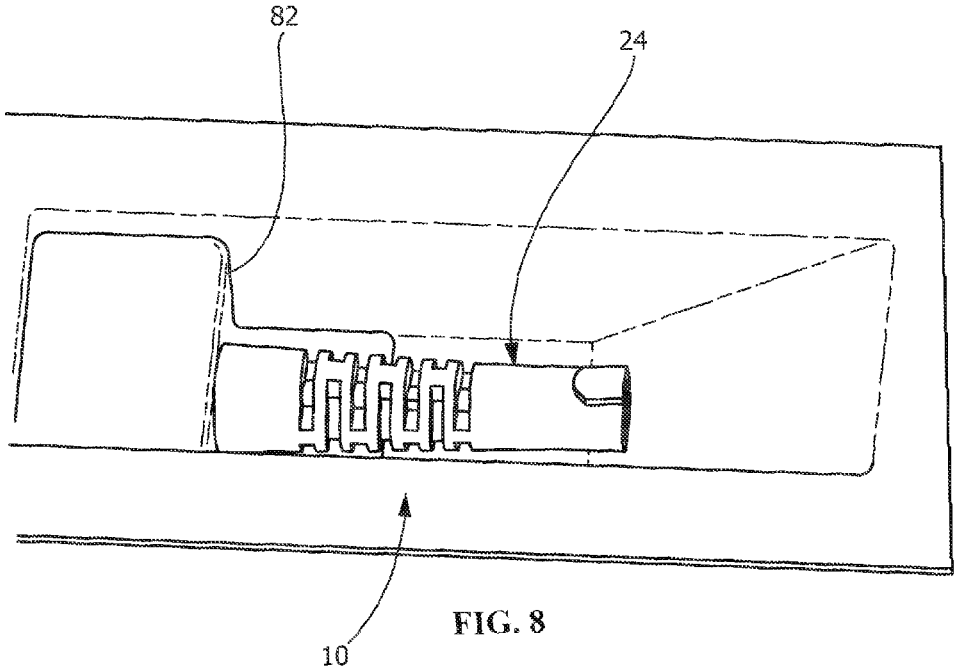
FIG. 8 is a perspective view of the flexible breakaway connector of FIG. 7 showing the additional movement and flexibility of the portion of the flexible breakaway connector.
Figure 9:
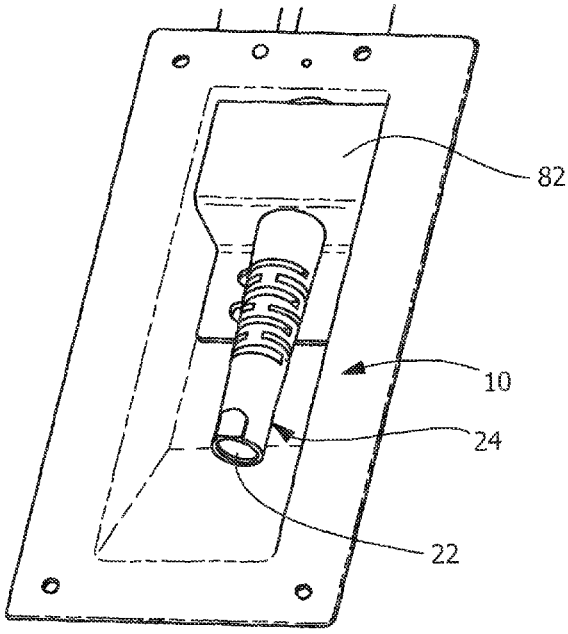
FIG. 9 is a perspective view of the flexible breakaway connector of FIG. 8 showing the additional movement and flexibility of the portion of the flexible breakaway connector.

Referring to FIGS. 4 through 9, the operation and movement of the flexible connector is illustrated. As shown in FIGS. 4 and 5, the feed-through member 20 is attached to a panel 82 by means of threads 56. The overmolded flexible relief section 24 and in-line receptacle connector 22 extend outward therefrom for mating to the mating connector 14. In the position shown in FIGS. 4 and 5, no forces, either axial or off-axis, are exerted on the flexible connector 10.

Referring to FIGS. 6 through 9, the flexible connector 10 is shown bent or deflected away from the position of FIGS. 4 and 5. The movement of the flexible connector 10 may be caused by the user attempting to connect the mating connector to the flexible connector. Alternatively, the deflection of the flexible connector 10 may be caused by an off-axis force being applied to the mating connector or cable attached to the receptacle connector 22. For purposes of illustration, the mating connector is not shown in these FIGS.; only the motion associated with the flexible connector is illustrated.

As shown, the flexible section 24 allows the receptacle connector 22 to move and rotate about fixed feed-through member 20. Consequently, as a typical force is applied to the mating connector or the cable, with an axial component and a transverse component, the flexible section 24 is bent in the direction of the transverse component, thereby allowing the force to align with the adjusted axis of the receptacle connector 22 and mating connector 14. This allows the mating connector to be pulled from the receptacle connector 22 in line with the adjusted axis, thereby preventing the mating connector from being pulled from the receptacle connector 22 at an angle, and thereby preventing damage to the retention members, the contacts and the connector in general. This facilitates the use of the breakaway connector assembly 12 over many cycles.

In addition, when the mating connector 14 or cable is pulled at an angle relative to the axial direction of engagement between the flexible connector 10 and the mating connector 14, the off-axis force does not cause oblique loading on the flexible connector 10 or the mating connector 14, as the flexible connector 10 bends to essentially convert the off-axis forces into axial forces in the repositioned end of the flexible connector 10. Therefore, the force needed to disconnect the mating connector 14 from the flexible connector 10 is maintained no matter how the mating connector 14 or the cable is pulled. This prevents the mating connector 14 from binding with the flexible connector 10, and prevents any increase in the axial force required to separate the mating connector 14 from the flexible connector 10, thereby minimizing damage to the connector components or panel and facilitating the use of the breakaway connector assembly 12 over many cycles.

Similarly, when the flexible connector 10 or cable is pulled at an angle relative to the axial direction of engagement between the flexible connector 10 and the mating connector 14, the off-axis force does not cause oblique loading on the flexible connector 10 or the mating connector 14, as the flexible connector 10 bends to essentially convert the off-axis forces into axial forces in the repositioned end of the flexible connector 10. Therefore, the force needed to disconnect the flexible connector 10 from the mating connector 14 is maintained no matter how the flexible connector 10 or the cable is pulled. This prevents the flexible connector 10 from binding with the mating connector 14, and prevents any increase in the axial force required to separate the flexible connector 10 from the mating connector 14, thereby minimizing damage to the connector components or panel and facilitating the use of the breakaway connector assembly 12 over many cycles.

FIGS. 10-13 illustrate a flexible connector 10 which is not mounted to a panel. While the feed-through member is not attached, the flexible connector 10 and the connector assembly 12 are often combined in tight spaces. In these spaces, the feed-through end of the flexible connector 10 can often become trapped or essentially fixed. In these applications, the operation and function of the flexible section 24 is as described above.

The use of the flexible section 24 also allows for the connection between the mating connector 12 and flexible connector 10 to be easily accomplished in all environments. As the receptacle connector 22 can be moved, a user attempting to mate the mating connector 14 thereto need not align the mating connector in a precise orientation to the flexible connector 10. This allows for the connection between connectors 10, 14 to be accomplished quickly and effectively, even in environments which are not user friendly, such as in military or industrial applications.

Due to the flexibility provided in the flexible connector 10, damage to the connectors and components is minimized, allowing for precise repeatability over many cycles. Therefore, the flexible connector 10 can be used over many cycles with little or no risk of failure.

The present invention has been described relative to the exemplary embodiments. Since it will be understood by those skilled in the art that various changes may be made and equivalents may be substituted for elements thereof without departing from the scope of the invention, it is intended that all matter contained in the above description or shown in the accompanying drawings be interpreted as illustrative and not in a limiting sense. It should be understood that the present disclosure is for the purpose of illustration only, and that the invention includes all modifications and equivalents falling within the appended claims.

It is also to be understood that the following claims are to cover all generic and specific features of the invention described herein, and all statements of the scope of the invention which, as a matter of language, might be said to fall therebetween. Therefore, it is intended that the invention not be limited to the particular embodiment disclosed as the best mode contemplated for carrying out this invention, but that the invention will include all embodiments falling within the scope of the appended claims.

The invention claimed is:

1. A connector assembly that automatically disengages at a predetermined breakaway force, the connector assembly comprising:

a receptacle;

an overmolded flexible portion which allows the connector to move relative to a feed-through member, the flexible portion being overmolded to a portion of the receptacle;

the feed-through member extending from a first end of the flexible portion, the flexible portion being overmolded to a portion of the feed-through member;

the flexible portion bends in response to non-axial forces applied thereto, wherein when off-axis forces are applied to the connector assembly or a mating connector assembly, the flexible portion bends to convert the off-axis forces into axial forces, wherein the off-axis forces do not cause oblique loading on the connector assembly or a mating connector.

2. The connector assembly as recited in claim 1 wherein the feed-through member has a housing with an opening to allow a cable to extend therethrough, a first end of the housing has threads for mounting to a panel, a second end has at least one member provided thereon to cooperate with the flexible portion.

3. The connector assembly as recited in claim 1 wherein the flexible portion has at least one recess provided therein, the at least one recess allows the flexible portion to maintain its strength in the axial direction while allowing the flexible portion to bend and twist in a non-axial direction.

4. The connector assembly as recited in claim 1 wherein the feed-through member extends from a first end of the flexible portion and the receptacle extends from a second end of the flexible portion.

5. The connector assembly as recited in claim 4 wherein the flexible portion cooperates with the feed-through member and the receptacle to provide sealing therebetween.

6. The connector assembly as recited in claim 4 wherein the flexible portion allows the receptacle to move and flex about the feed-through member as the force is applied to the connector or mating connector, the force having an axial component and a transverse component, whereby the flexible portion is bent in the direction of the transverse component, allowing the force to align with the adjusted axis of the receptacle and the mating connector, allowing the mating connector to be pulled from the receptacle in line with the adjusted axis, and preventing the mating connector from being pulled from the receptacle at an angle.

7. The connector assembly as recited in claim 4 wherein the receptacle has a retaining ring mounted in a recess.

8. The connector assembly as recited in claim 7 wherein the retaining ring extends by more than 180 degrees about an axis of the receptacle, the retaining ring configured to expand within the recess.

9. A breakaway connector that automatically disengages at a predetermined force for mating with a mating connector, the breakaway connector comprising:

a first end having a receptacle and a second end having a feed-through member, the receptacle configured to mate with the mating connector;

an overmolded flexible portion positioned between the first end and the second end, the flexible portion being overmolded to a portion of the receptacle and to a portion of the feed-though member, the flexible portion allowing the second end and the feed-through member to move relative to the first end and the receptacle;

whereby when off-axis forces are applied to the connector or a mating connector, the flexible portion bends to move the second end of the connector and the feed-through member to convert the off-axis forces into axial forces to allow the mating connector to be properly disengaged from the second end even if off-axis forces are applied to the mating connector.

10. The breakaway connector as recited in claim 9 wherein the flexible portion cooperates with the feed-through member and the receptacle to provide sealing therebetween.

11. The breakaway connector as recited in claim 9 wherein the flexible portion has at least one recess provided therein, the at least one recess allows the flexible portion to maintain its strength in the axial direction while allowing the flexible portion to bend and twist in a non-axial direction.

12. The breakaway connector as recited in claim 9 wherein the flexible portion allows the receptacle to move and rotate about the feed-through member as the force is applied to the connector or mating connector, the force having an axial component and a transverse component, whereby the flexible portion is bent in the direction of the transverse component, allowing the force to align with the adjusted axis of the receptacle and the mating connector, allowing the mating connector to be pulled from the receptacle in line with the adjusted axis, and preventing the mating connector from being pulled from the receptacle at an angle.

13. The breakaway connector as recited in claim 9 wherein the receptacle has a retaining ring mounted in a recess.

14. The breakaway connector as recited in claim 13 wherein the retaining ring extends by more than 180 degrees about an axis of the receptacle, the retaining ring configured to expand within the recess.

15. A connector for mating with a mating connector, the connector automatically disengages from the mating connector at a predetermined breakaway force, the connector comprising:

an overmolded flexible portion provided between a first end and a second end of the connector, the first end having a receptacle and the second end having a feed-through member, the flexible portion being overmolded to a portion of the receptacle and to a portion of the feed-though member, the flexible portion configured to bend in response to non-axial forces, allowing the second end to move relative to the first end;

whereby the mating connector can be mated or unmated to the second end at an angle relative to the longitudinal axis of the unflexed connector without damaging the connector or the mating connector, when off-axis forces are applied to the connector or the mating connector, the flexible portion bends to convert the off-axis forces into axial forces, wherein the off-axis forces do not cause oblique loading on the connector or the mating connector allowing the connector to be disengaged from the mating connector without binding.

16. The connector as recited in claim 15 wherein the flexible portion allows the receptacle to move and rotate about the feed-through member as the force is applied to the connector or mating connector, the force having an axial component and a transverse component, whereby the flexible portion is bent in the direction of the transverse component, allowing the force to align with the adjusted axis of the receptacle and the mating connector, allowing the mating connector to be pulled from the receptacle in line with the adjusted axis, and preventing the mating connector from being pulled from the receptacle at an angle.

17. The connector as recited in claim 15 wherein the flexible portion cooperates with the feed-through member and the receptacle to provide sealing therebetween.

18. The connector as recited in claim 15 wherein the flexible portion has at least one recess provided therein, the at least one recess allows the flexible portion to maintain its strength in the axial direction while allowing the flexible portion to bend and twist in a non-axial direction.

* * * * *